US009752103B2

(12) United States Patent
Patterson et al.

(10) Patent No.: US 9,752,103 B2
(45) Date of Patent: Sep. 5, 2017

(54) DETERGENT COMPOSITION

(71) Applicant: The Procter & Gamble Company, Cincinnati, OH (US)

(72) Inventors: Steven George Patterson, Tyne & Wear (GB); Philip Frank Souter, Northumberland (GB)

(73) Assignee: The Procter & Gamble Company, Cincinnati, OH (US)

( * ) Notice: Subject to any disclaimer, the term of this patent is extended or adjusted under 35 U.S.C. 154(b) by 81 days.

(21) Appl. No.: 13/914,696

(22) Filed: Jun. 11, 2013

(65) Prior Publication Data

US 2014/0364353 A1 Dec. 11, 2014

(51) Int. Cl.

| | |
|---|---|
| ***C11D 3/386*** | (2006.01) |
| ***C11D 3/395*** | (2006.01) |
| ***C11D 3/40*** | (2006.01) |
| ***C11D 3/39*** | (2006.01) |
| ***C11D 1/66*** | (2006.01) |
| ***C11D 3/37*** | (2006.01) |
| ***C11D 1/02*** | (2006.01) |
| ***C11D 3/22*** | (2006.01) |
| ***C11D 3/04*** | (2006.01) |
| ***C11D 3/10*** | (2006.01) |
| ***C11D 3/12*** | (2006.01) |

(52) U.S. Cl.

CPC ..... *C11D 3/38672* (2013.01); *C11D 1/02* (2013.01); *C11D 1/66* (2013.01); *C11D 3/046* (2013.01); *C11D 3/10* (2013.01); *C11D 3/126* (2013.01); *C11D 3/22* (2013.01); *C11D 3/37* (2013.01); *C11D 3/38636* (2013.01); *C11D 3/3905* (2013.01); *C11D 3/3942* (2013.01); *C11D 3/40* (2013.01)

(58) Field of Classification Search

CPC .. C11D 1/02; C11D 1/66; C11D 3/046; C11D 3/10; C11D 3/22; C11D 3/37; C11D 3/38656; C11D 3/40; C11D 3/3905; C11D 3/3942; C11D 3/38636

USPC ..... 510/305, 306, 313, 320, 321, 393, 372, 510/374, 376, 470, 475, 476, 349

See application file for complete search history.

(56) References Cited

U.S. PATENT DOCUMENTS

| | | | | |
|---|---|---|---|---|
| 3,451,935 | A | 6/1969 | Roald et al. | |
| 4,381,247 | A | 4/1983 | Nakagawa et al. | |
| 4,767,557 | A | 8/1988 | Herdeman | |
| 5,318,714 | A | 6/1994 | Markussen et al. | |
| 5,376,288 | A * | 12/1994 | Falholt et al. | 510/301 |
| 6,127,329 | A * | 10/2000 | Baillely et al. | 510/320 |
| 6,420,331 | B1 * | 7/2002 | Bettiol et al. | 510/392 |
| 6,440,911 | B1 * | 8/2002 | Bettiol et al. | 510/137 |
| 6,602,841 | B1 * | 8/2003 | Becker | C11D 3/38672 435/176 |
| 6,933,141 | B1 * | 8/2005 | Bach | 435/187 |
| 7,273,736 | B2 * | 9/2007 | Bach | 435/187 |
| 2002/0137654 | A1 * | 9/2002 | Hage et al. | 510/392 |
| 2003/0050211 | A1 * | 3/2003 | Hage et al. | 510/305 |
| 2005/0054068 | A1 * | 3/2005 | Bach | 435/182 |
| 2005/0187130 | A1 | 8/2005 | Brooker et al. | |
| 2007/0027053 | A1 * | 2/2007 | Di Bono | 510/302 |
| 2008/0206830 | A1 * | 8/2008 | Becker | C11D 3/38672 435/174 |
| 2009/0156454 | A1 | 6/2009 | Schmiedel et al. | |
| 2009/0176681 | A1 * | 7/2009 | Kaneda et al. | 510/311 |
| 2009/0291483 | A1 * | 11/2009 | Bach | 435/187 |
| 2010/0006463 | A1 * | 1/2010 | Batchelor et al. | 206/459.5 |
| 2010/0016206 | A1 * | 1/2010 | Warkotsch et al. | 510/299 |
| 2010/0022430 | A1 * | 1/2010 | Gould et al. | 510/357 |
| 2010/0190673 | A1 * | 7/2010 | Smets | B01J 13/02 510/103 |
| 2010/0261633 | A1 * | 10/2010 | Oki et al. | 510/276 |
| 2011/0053820 | A1 * | 3/2011 | Souter | C11D 3/386 510/224 |
| 2011/0065163 | A1 * | 3/2011 | Becker et al. | 435/187 |
| 2011/0301072 | A1 * | 12/2011 | Smith et al. | 510/227 |

FOREIGN PATENT DOCUMENTS

| | | |
|---|---|---|
| DE | 4315397 | 5/1993 |
| WO | WO 90/09440 | 8/1990 |
| WO | WO 94/16064 | 1/1994 |
| WO | WO 97/39116 A1 | 10/1997 |

OTHER PUBLICATIONS

International Search Report, dated Nov. 12, 2012, containing 6 pages.

* cited by examiner

*Primary Examiner* — Gregory R Delcotto

(74) *Attorney, Agent, or Firm* — John T. Dipre; Steven W. Miller

(57) ABSTRACT

Detergent compositions are described having more than one enzyme, in particular having a multi-enzyme co-particle as well as methods of making and using such detergents. The compositions also have low levels of zeolite and phosphate builders and a moisture sink to minimize interaction between enzymes.

7 Claims, No Drawings

DETERGENT COMPOSITION

FIELD OF INVENTION

This invention relates to detergent compositions comprising more than one enzyme as well as methods of making and using such detergents.

BACKGROUND OF THE INVENTION

There is increasing pressure on natural resources, especially energy and water and also demand on use of petrochemicals continues to grow. Detergent compositions comprising enzymes have been known for many years and offer the opportunity to deliver outstanding cleaning, care and freshness benefits from detergents particularly in low water and/or low temperature washes, while reducing the need to rely so heavily on petrochemical-based materials. Such a formulation approach does bring with it considerable challenges associated with how to deliver consistent outstanding cleaning from products that need to be stable on shelf for many months in an affordable manner. This problem is particularly acute in warmer parts of the world.

In IP.com disclosure IPCOM000200739D it is disclosed that uniform enzyme granule distribution can be improved by incorporating two or more enzymes combined in one co-granule. Each enzyme will then be present in more granules securing a more uniform distribution of enzymes in the detergent. This also reduces the physical segregation of different enzymes due to different particle sizes. However, for detergent compositions stored under conditions of high temperature and/or humidity, interaction between enzymes in an enzyme cogranule can lead to loss of enzyme activity, in particular when one of the enzymes is protease. This problem is particularly acute in detergent compositions comprising low levels of typical strong builders i.e. zeolite and phosphate builders.

SUMMARY OF THE INVENTION

The present invention relates to a detergent composition comprising (a) a multi-enzyme co-granule; (b) less than 10 wt % zeolite (anhydrous basis); and (c) less than 10 wt % phosphate salt (anhydrous basis), wherein said enzyme co-granule comprises from 10 to 98 wt % moisture sink component and the composition additionally comprises from 20 to 80 wt % detergent moisture sink component.

The invention also relates to a method of treating and/or cleaning a surface, preferably a fabric surface comprising the steps of (i) contacting said surface with the detergent composition as claimed and described herein in an aqueous wash liquor, (ii) rinsing and/or drying the surface. Preferably the temperature of the aqueous liquor is from 5-25° C. and preferably the aqueous liquor comprises from 0.1 g/l to 3 g/l of surfactant.

DETAILED DESCRIPTION OF THE INVENTION

Definitions

As used herein "detergent composition" means consumer and institutional products, including but not limited to cleaning and/or treatment compositions, particularly cleaning compositions for laundry, dishwashing, and hard surface cleaning products, other cleaners, and cleaning systems all for the care and cleaning of inanimate surfaces, as well as fabric conditioner products and other products designed specifically for the care and maintenance of fabrics. Such detergent composition are generally intended to be used or consumed in the form in which they are sold. Such products include laundry and rinse additive and/or care, hard surface cleaning and/or treatment including floor and toilet bowl cleaners. Preferably the compositions of the invention are laundry or dish-washing detergents, most preferably laundry detergents. Typically the compositions of the invention are solid i.e. in granular or powder-form, which may optionally be incorporated into a unit-dose detergent composition such as a tablet or pouch which may be single or multi-compartment. However, they may be liquid, gel or paste-form. In a pouch the composition of the invention will be present within a water-soluble film. Where the pouch is multi-compartment, the composition of the invention will be present in one or more compartments. Further compositions, not in accordance with the invention may be provided in one or more further compartments of the multi-component pouch. All of such products which are applicable may be in standard, concentrated or even highly concentrated form even to the extent that such products may in certain aspect be non-aqueous.

As used herein, articles such as "a" and "an" when used in a claim, are understood to mean one or more of what is claimed or described. As used herein, the terms "include", "includes" and "including" are meant to be non-limiting. As used herein, the term "solid" includes granular, powder, bar and tablet product forms. Unless otherwise noted, all component or composition levels are in reference to the active portion of that component or composition, and are exclusive of impurities, for example, residual solvents or by-products, which may be present in commercially available sources of such components or compositions. All percentages and ratios are calculated by weight unless otherwise indicated. All percentages and ratios are calculated based on the total composition unless otherwise indicated.

Multi-Enzyme Co-Granule

The multi-enzyme co-granule comprises at least two enzymes, or at least three or four or more enzymes, preferably selected from the group consisting of first-wash lipases, cleaning cellulases, xyloglucanases, perhydrolases, peroxidases, lipoxygenases, laccases, hemicellulases, proteases, care cellulases, cellobiose dehydrogenases, xylanases, phospholipases, esterases, cutinases, pectinases, mannanases, pectate lyases, keratinases, reductases, oxidases, phenoloxidases, ligninases, pullulanases, tannases, pentosanases, lichenases glucanases, arabinosidases, hyaluronidase, chondroitinase, amylases, and mixtures thereof. Preferably the co-granule comprises (a) one or more enzymes selected from the group consisting of first-wash lipases, cleaning cellulases, xyloglucanases, perhydrolases, peroxidases, lipoxygenases, laccases and mixtures thereof. Preferred enzymes from group (a) are first wash lipases. In addition the co-granule preferably comprises (b) one or more enzymes selected from the group consisting of hemicellulases, proteases, care cellulases, cellobiose dehydrogenases, xylanases, phospholipases, esterases, cutinases, pectinases, mannanases, pectate lyases, keratinases, reductases, oxidases, phenoloxidases, ligninases, pullulanases, tannases, pentosanases, lichenases glucanases, arabinosidases, hyaluronidase, chondroitinase, amylases, and mixtures thereof. Preferably the co-granule comprises a protease enzyme.

The co-granule may comprise for example at least two enzymes, for example including: (i) protease and amylase; (ii) protease and cellulase; (iii) protease and first wash lipase; (iv) cellulase an first wash lipase; (v) amylase and cellulase; or (vi) amylase and first wash lipase. Alternatively the co-granule may comprise at least three enzymes, for example including (i) protease, first wash lipase and cellulase; (ii) protease, amylase and cellulase; (iii) protease, amylase and first wash lipase; (iv) first wash lipase, amylase and cellulase. Alternatively, the co-granule may comprise at least four enzymes, for example including (i) protease, amylase, first wash lipase and cellulase; (ii) protease, amylase, first wash lipase and mannanase.

The amount of total active enzyme protein incorporated into the co-granule is typically delivers from 0.2 to 1.0 wt % active enzyme in the detergent composition.

Moisture Sink Component

The moisture sink component is present in the co-granule in amounts of from 10 to 99 wt % of the co-granule. Preferably the moisture sink material is herein understood a material that in its anhydrous form can take water to become hydrated and it can easily give up the hydration water when it is placed in a drier or warmer environment. Preferably the moisture sink materials for use in the composition of the invention have a difference in density between the anhydrous and hydrated form of at least 0.8 g/cm3, more preferably at least 1 g/cm3 and especially at least 1.2 g/cm3. This difference in densities provides a mechanism to break particle:particle crystal bridges that have formed as a result of water condensing as the powder temperature fell below the dew point associated with that powder. As the temperature increases following a period of cooling (as in a temperature cycle), the hydrated material forming a crystal bridge between particles reverts to the anhydrous (or less hydrated) form. The higher crystal density associated with the anhydrous (or less hydrated) form provides a mechanism for breaking these crystal bridges due to the reduction in crystal volume. This allows that a period of low temperature does not negatively and permanently affect the structure of the powder and contributes to good handling properties of the composition.

Preferably the moisture sink component is present in amounts from 30, 50 or even 60 wt % of the co-granule, up to 90 or 95 wt % based on the co-granule. Examples of suitable moisture sink components are capable of absorbing moisture. Suitable moisture sink components are preferably selected from the group consisting of (a) hydratable salts, (b) dessicated clays, (c) bio-filler, and (d) mixtures thereof. Useful as hydratable salts are typically sodium, calcium, magnesium salts, preferably sodium salts of carbonate, chloride, citrate and sulphate and mixtures thereof. Anhydrous sodium carbonate may be preferred. Light sodium carbonate may be preferred.

As examples of suitable clays are talc, calcite, kaolin, dolomite and bentonite. Preferred dessicated clays have a moisture content of from 0.1 to 20 wt % free moisture, more preferably from 0.1 to 15 or even 0.1 to 10 or even 5 wt % free moisture;

Suitable as bio-filler is any water soluble or water insoluble agricultural by-product. Examples of water-insoluble agricultural by-products are described in WO2007/147698. Preferred bio-fillers have a moisture content of from 0.1 to 20 wt % free moisture, more preferably from 0.1 to 15 or even 0.1 to 10 wt % or even 5 wt % free moisture;

The particle size of the moisture sink component is preferably such that at least 90 wt % of the particles of moisture sink component have a diameter less than 700 or even less than 500 or 300 or 250 microns or even less than 100 microns.

The weight ratio of moisture sink component to active enzyme protein in the co-granule is preferably from 10:1 or 20:1 or 50:1 or 10:1 up to 100:1 or 90:1 or 75:1.

Enzyme Co-Granules

Suitable enzyme co-granules for use herein include those formed according to any of the below technologies:

a) Spray dried products, wherein a liquid enzyme-containing solution is atomised in a spray drying tower to form small droplets which during their way down the drying tower dry to form an enzyme-containing particulate material. Very small particles can be produced this way (Michael S. Showell (editor); Powdered detergents; Surfactant Science Series; 1998; vol. 71; page 140-142; Marcel Dekker).

b) Layered products, wherein the enzyme is coated as a layer around a pre-formed inert core particle, wherein an enzyme-containing solution is atomised, typically in a fluid bed apparatus wherein the pre-formed core particles are fluidised, and the enzyme-containing solution adheres to the core particles and dries up to leave a layer of dry enzyme on the surface of the core particle. Particles of a desired size can be obtained this way if a useful core particle of the desired size can be found. This type of product is described in e.g. WO 97/23606 c) Absorbed core particles, wherein rather than coating the enzyme as a layer around the core, the enzyme is absorbed onto and/or into the surface of the core. Such a process is described in WO 97/39116.

d) Extrusion or pelletized products, wherein an enzyme-containing paste is pressed to pellets or under pressure is extruded through a small opening and cut into particles which are subsequently dried. Such particles usually have a considerable size because of the material in which the extrusion opening is made (usually a plate with bore holes) sets a limit on the allowable pressure drop over the extrusion opening. Also, very high extrusion pressures when using a small opening increase heat generation in the enzyme paste, which is harmful to the enzyme. (Michael S. Showell (editor); Powdered detergents; Surfactant Science Series; 1998; vol. 71; page 140-142; Marcel Dekker)

e) Prilled products or, wherein an enzyme powder is suspended in molten wax and the suspension is sprayed, e.g. through a rotating disk atomiser, into a cooling chamber where the droplets quickly solidify (Michael S. Showell (editor); Powdered detergents; Surfactant Science Series; 1998; vol. 71; page 140-142; Marcel Dekker). The product obtained is one wherein the enzyme is uniformly distributed throughout an inert material instead of being concentrated on its surface. Also U.S. Pat. No. 4,016,040 and U.S. Pat. No. 4,713,245 are documents relating to this technique f) Mixer granulation products, wherein an enzyme-containing liquid is added to a dry powder composition of conventional granulating components. The liquid and the powder in a suitable proportion are mixed and as the moisture of the liquid is absorbed in the dry powder, the components of the dry powder will start to adhere and agglomerate and particles will build up, forming granulates comprising the enzyme. Such a process is described in U.S. Pat. No. 4,106,991 (NOVO NORDISK) and related documents EP 170360 B1, EP 304332 B1, EP 304331, WO 90/09440 and WO 90/09428. In a particular product of this process wherein various high-shear mixers can be used as granulators, granulates consisting of the enzyme, fillers and binders etc. are mixed with cellulose fibres to reinforce the particles to give the so-called T-granulate. Reinforced particles, being more robust, release less enzymatic dust.

Preferred enzyme co-granules, for use in the composition of the invention, have a core-shell structure. In preferred core-shell embodiments the core comprises a central part, preferably free of enzymes, and a surrounding layer containing enzymes and the shell comprises a plurality of layers, the most outer layer being a protective layer. In preferred embodiments the central part of the core and at least one of the layers of the shell comprise an moisture sink material. Preferably the central part of the core represents from 1% to 60%, more preferably from 3% to 50% and especially from 5% to 40% by weight of the total particle. Preferably the layer comprising the moisture sink material represents from 0.5% to 40%, more preferably from 1% to 30% and especially from 3% to 20% by weight of the total particle. Preferably the most outer layer comprises polyvinyl alcohol, more preferably titanium oxide (for aesthetic reasons) and especially a combination thereof. Preferably the protective layer represents from 0.05% to 20%, more preferably from 0.1% to 15% and especially from 1% to 3% by weight of the total particle. The enzyme granulate can also contain adjunct materials such as antioxidants, dyes, activators, solubilizers, binders, etc. Enzymes according to this embodiment can be made by a fluid bed layering process similar to that described in U.S. Pat. No. 5,324,649, U.S. Pat. No. 6,602,841 B1 and US2008/0206830A1.

Enzymes according to this embodiment can also be made by a combination of processes. Such enzyme co-granules are built around a core that can be free of enzymes or contain enzymes (preferably comprising an moisture sink material, more preferably sodium sulphate) that can be made using a variety of processes including use of either a mixer granulator or an extruder. The cores are then treated in a fluid bed process wherein the enzyme is sprayed onto the core. The core is then coated by a layer, preferably comprising an moisture sink material, and more preferably sodium sulphate and finally is coated with a polymer selected from the group comprising hydroxpropylmethylcellulose and/or polyvinylalcohol and derivatives thereof, optionally also containing additional titanium dioxide, polyethylene glycol and/or kaolin or any mixtures thereof. Processes suitable for making the enzyme granulate for use herein are described in U.S. Pat. No. 6,348,442 B2, US 2004/0033927 A1, U.S. Pat. No. 7,273,736, WO 00/01793, U.S. Pat. No. 6,268,329 B1 and US2008/0206830A1. Preferably, the granulate comprises from about 30% to about 75%, preferably from about 40 to about 50% by weight of the granulate of an moisture sink material, selected from the group comprising sodium sulphate, sodium citrate and mixtures thereof, preferably sodium sulphate.

Preferably, the enzyme co-granules have a weight geometric mean particle size of from about 200 μm to about 1200 μm, more preferably from about 300 μm to about 1000 μm and especially from about 400 μm to about 600 μm.

In addition to the co-granule, the compositions of the invention comprise less than 10 wt % zeolite (anhydrous basis), more preferably less than 7 or 5 or even below 3 wt % zeolite. Zeolite may even be completely absent from the detergent compositions of the invention.

In addition to the co-granule, the compositions of the invention comprise less than 10 wt % phosphate salt (anhydrous basis), more preferably less than 7 or 5 or even below 3 wt % phosphate salt. Phosphate salts may even be completely absent from the detergent compositions of the invention.

In addition the compositions of the invention comprise from 20 to 80 wt % detergent moisture sink, preferably from 25, or 30 or 35 or 40 wt % to 75 wt % detergent moisture sink. Suitable detergent moisture sink components are capable of absorbing moisture and selected from the group consisting of (a) hydratable sulphate salts, (b) dessicated clays, (c) bio-filler, and (d) mixtures thereof. Useful salts are typically as hydratable sodium, calcium, magnesium salts of sulphate and mixtures thereof. Sodium sulphate is particularly preferred, most preferably in its anhydrous form. Light salts may also be preferred.

As examples of suitable clays are talc, calcite, kaolin, dolomite and bentonite. Preferred dessicated clays have a moisture content of from 0.1 to 20 wt % free moisture, more preferably from 0.1 to 15 or even 0.1 to 10 or even 5 wt % free moisture.

Suitable as bio-filler is any water soluble or water insoluble agricultural by-product. Examples of water-insoluble agricultural by-products are described in WO2007/147698. Preferred bio-fillers have a moisture content of from 0.1 to 20 wt % free moisture, more preferably from 0.1 to 15 or even 0.1 to 10 wt % or even 5 wt % free moisture.

Sodium sulphate is the most preferred detergent moisture sink component.

The detergent moisture sink component may be dry-added to other detergent adjunct ingredients or may be incorporated into the detergent composition via a pre-formed particle such as an agglomerate or blown powder (particulate formed from a spray-drying process), or may be incorporated via a mixture of these routes. In a preferred composition the detergent moisture sink component is incorporated into the detergent composition as a dry-added particulate component comprising at least 80 wt %, or even at least 90 wt % or even at least 95 wt % of the detergent moisture sink and in addition via a blown powder comprising from 15 to 70 wt %, or from 20 to 60 wt % based on the blown powder, of the detergent moisture sink component. Typically where the moisture sink component is incorporated via an agglomerate particle and/or blown powder particle such particle will comprise at least 10 wt % surfactant, based on the weight of the particle. In a particularly preferred composition of the invention, the composition will comprise dry-added sodium sulphate and blown powder and/or agglomerate, preferably blown powder, comprising sodium sulphate.

In accordance with a preferred aspect of the invention, the detergent composition additionally comprises a dye transfer inhibiting agent and/or a fabric hueing agents.

Adjunct Materials

The detergent compositions of the invention may comprise one or more (detergent) adjunct materials. These may enhance cleaning performance, for treatment of the substrate to be cleaned, or modify the aesthetics of the composition for example as is the case with perfumes, speckles, colorants, dyes or the like. The levels of any such adjuncts incorporated in the composition of the invention any fabric and home care product are in addition to any materials previously recited for incorporation. The precise nature of these additional components, and levels of incorporation thereof, will depend on the physical form of the consumer product and the nature of the cleaning operation for which it is to be used. Suitable adjunct materials include, but are not limited to, surfactants, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, hueing dyes, perfumes, perfume delivery systems, structure elasticizing agents, fabric softeners, carriers, hydrotropes, processing aids, solvents and/or pigments. Examples of suitable adjuncts are described below. In addition to the disclosure below, suitable examples of such other adjuncts and levels of use are found in U.S. Pat. Nos. 5,576,282, 6,306,812 B1 and 6,326,348 B1 that are incorporated by reference.

Fabric Hueing Agents: The composition may comprise a fabric hueing agent. Suitable fabric hueing agents include dyes, dye-clay conjugates, and pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof.

In another aspect, suitable small molecule dyes include small molecule dyes selected from the group consisting of Colour Index (Society of Dyers and Colourists, Bradford, UK) numbers Direct Violet 9, Direct Violet 35, Direct Violet 48, Direct Violet 51, Direct Violet 66, Direct Violet 99, Direct Blue 1, Direct Blue 71, Direct Blue 80, Direct Blue 279, Acid Red 17, Acid Red 73, Acid Red 88, Acid Red 150, Acid Violet 15, Acid Violet 17, Acid Violet 24, Acid Violet 43, Acid Red 52, Acid Violet 49, Acid Blue 15, Acid Blue 17, Acid Blue 25, Acid Blue 29, Acid Blue 40, Acid Blue 45, Acid Blue 75, Acid Blue 80, Acid Blue 83, Acid Blue 90 and Acid Blue 113, Acid Black 1, Basic Violet 1, Basic Violet 3, Basic Violet 4, Basic Violet 10, Basic Violet 35, Basic Blue 3, Basic Blue 16, Basic Blue 22, Basic Blue 47, Basic Blue 66, Basic Blue 75, Basic Blue 159 and mixtures thereof. In another aspect, suitable small molecule dyes include small molecule dyes selected from the group consisting of Colour Index (Society of Dyers and Colourists, Bradford, UK) numbers Acid Violet 17, Acid Violet 43, Acid Red 52, Acid Red 73, Acid Red 88, Acid Red 150, Acid Blue 25, Acid Blue 29, Acid Blue 45, Acid Blue 113, Acid Black 1, Direct Blue 1, Direct Blue 71, Direct Violet 51 and mixtures thereof. In another aspect, suitable small molecule dyes include small molecule dyes selected from the group consisting of Colour Index (Society of Dyers and Colourists, Bradford, UK) numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing conjugated chromogens (dye-polymer conjugates) and polymers with chromogens co-polymerized into the backbone of the polymer and mixtures thereof.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® (Milliken, Spartanburg, S.C., USA) Violet CT, carboxymethyl cellulose (CMC) conjugated with a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used). Suitable fabric hueing agents can be purchased from Aldrich, Milwaukee, Wis., USA; Ciba Specialty Chemicals, Basel, Switzerland; BASF, Ludwigshafen, Germany; Dayglo Color Corporation, Mumbai, India; Organic Dyestuffs Corp., East Providence, R.I., USA; Dystar, Frankfurt, Germany; Lanxess, Leverkusen, Germany; Megazyme, Wicklow, Ireland; Clariant, Muttenz, Switzerland; Avecia, Manchester, UK and/or made in accordance with the examples contained herein. Suitable hueing agents are described in more detail in U.S. Pat. No. 7,208,459 B2.

Encapsulates: The composition may comprise an encapsulate. In one aspect, an encapsulate comprising a core, a shell having an inner and outer surface, said shell encapsulating said core.

In one aspect of said encapsulate, said core may comprise a material selected from the group consisting of perfumes; brighteners; dyes; insect repellants; silicones; waxes; flavors; vitamins; fabric softening agents; skin care agents in one aspect, paraffins; enzymes; anti-bacterial agents; bleaches; sensates; and mixtures thereof; and said shell may comprise a material selected from the group consisting of polyethylenes; polyamides; polystyrenes; polyisoprenes; polycarbonates; polyesters; polyacrylates; aminoplasts, in one aspect said aminoplast may comprise a polyureas, polyurethane, and/or polyureaurethane, in one aspect said polyurea may comprise polyoxymethyleneurea and/or melamine formaldehyde; polyolefins; polysaccharides, in one aspect said polysaccharide may comprise alginate and/or chitosan; gelatin; shellac; epoxy resins; vinyl polymers; water insoluble inorganics; silicone; and mixtures thereof. In one aspect of said encapsulate, said core may comprise perfume. In one aspect of said encapsulate, said shell may comprise melamine formaldehyde and/or cross linked melamine formaldehyde.

In a one aspect, suitable encapsulates may comprise a core material and a shell, said shell at least partially surrounding said core material, is disclosed. At least 75%, 85% or even 90% of said encapsulates may have a fracture strength of from about 0.2 MPa to about 10 MPa, from about 0.4 MPa to about 5 MPa, from about 0.6 MPa to about 3.5 MPa, or even from about 0.7 MPa to about 3 MPa; and a benefit agent leakage of from 0% to about 30%, from 0% to about 20%, or even from 0% to about 5%. In one aspect, at least 75%, 85% or even 90% of said encapsulates may have a particle size of from about 1 microns to about 80 microns, about 5 microns to 60 microns, from about 10 microns to about 50 microns, or even from about 15 microns to about 40 microns. In one aspect, at least 75%, 85% or even 90% of said encapsulates may have a particle wall thickness of from about 30 nm to about 250 nm, from about 80 nm to about 180 nm, or even from about 100 nm to about 160 nm.

In one aspect, said encapsulates' core material may comprise a material selected from the group consisting of a perfume raw material and/or optionally a material selected from the group consisting of vegetable oil, including neat and/or blended vegetable oils including caster oil, coconut oil, cottonseed oil, grape oil, rapeseed, soybean oil, corn oil, palm oil, linseed oil, safflower oil, olive oil, peanut oil, coconut oil, palm kernel oil, castor oil, lemon oil and mixtures thereof; esters of vegetable oils, esters, including dibutyl adipate, dibutyl phthalate, butyl benzyl adipate, benzyl octyl adipate, tricresyl phosphate, trioctyl phosphate and mixtures thereof; straight or branched chain hydrocarbons, including those straight or branched chain hydrocarbons having a boiling point of greater than about 80° C.; partially hydrogenated terphenyls, dialkyl phthalates, alkyl biphenyls, including monoisopropylbiphenyl, alkylated naphthalene, including dipropylnaphthalene, petroleum spirits, including kerosene, mineral oil and mixtures thereof; aromatic solvents, including benzene, toluene and mixtures thereof; silicone oils; and mixtures thereof.

In one aspect, said encapsulates' wall material may comprise a suitable resin including the reaction product of an aldehyde and an amine, suitable aldehydes include, formaldehyde. Suitable amines include melamine, urea, benzoguanamine, glycoluril, and mixtures thereof. Suitable melamines include, methylol melamine, methylated methylol melamine, imino melamine and mixtures thereof. Suitable ureas include, dimethylol urea, methylated dimethylol urea, urea-resorcinol, and mixtures thereof.

In one aspect, suitable formaldehyde scavengers may be employed with the encapsulates, for example, in a capsule slurry and/or added to a consumer product before, during or after the encapsulates are added to such consumer product.

Suitable capsules that can be made by following the teaching of USPA 2008/0305982 A1; and/or USPA 2009/0247449 A1. Alternatively, suitable capsules can be purchased from Appleton Papers Inc. of Appleton, Wis. USA.

In addition, the materials for making the aforementioned encapsulates can be obtained from Solutia Inc. (St Louis, Mo. U.S.A.), Cytec Industries (West Paterson, N.J. U.S.A.), sigma-Aldrich (St. Louis, Mo. U.S.A.), CP Kelco Corp. of San Diego, Calif., USA; BASF AG of Ludwigshafen, Germany; Rhodia Corp. of Cranbury, N.J., USA; Hercules Corp. of Wilmington, Del., USA; Agrium Inc. of Calgary, Alberta, Canada, ISP of N.J. U.S.A., Akzo Nobel of Chicago, Ill., USA; Stroever Shellac Bremen of Bremen, Germany; Dow Chemical Company of Midland, Mich., USA; Bayer AG of Leverkusen, Germany; Sigma-Aldrich Corp., St. Louis, Mo., USA.

Polymers: The consumer product may comprise one or more polymers. Examples are carboxymethylcellulose, poly(vinyl-pyrrolidone), poly(ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid co-polymers.

The consumer product may comprise one or more amphiphilic cleaning polymers such as the compound having the following general structure: bis((C2H5O)(C2H4O)n)(CH3)-N+—CxH2x-N+—(CH3)-bis((C2H5O)(C2H4O)n), wherein n=from 20 to 30, and x=from 3 to 8, or sulphated or sulphonated variants thereof.

The consumer product may comprise amphiphilic alkoxylated grease cleaning polymers which have balanced hydrophilic and hydrophobic properties such that they remove grease particles from fabrics and surfaces. Specific embodiments of the amphiphilic alkoxylated grease cleaning polymers of the present invention comprise a core structure and a plurality of alkoxylate groups attached to that core structure. These may comprise alkoxylated polyalkylenimines, preferably having an inner polyethylene oxide block and an outer polypropylene oxide block.

Carboxylate polymer—The detergent composition of the present invention may also include one or more carboxylate polymers such as a maleate/acrylate random copolymer or polyacrylate homopolymer. In one aspect, the carboxylate polymer is a polyacrylate homopolymer having a molecular weight of from 4,000 Da to 9,000 Da, or from 6,000 Da to 9,000 Da.

Soil release polymer—The detergent composition of the present invention may also include one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Cellulosic polymer—The detergent composition of the present invention may also include one or more cellulosic polymers including those selected from alkyl cellulose, alkyl alkoxyalkyl cellulose, carboxyalkyl cellulose, alkyl carboxyalkyl cellulose. In one aspect, the cellulosic polymers are selected from the group comprising carboxymethyl cellulose, methyl cellulose, methyl hydroxyethyl cellulose, methyl carboxymethyl cellulose, and mixtures thereof. In one aspect, the carboxymethyl cellulose has a degree of carboxymethyl substitution from 0.5 to 0.9 and a molecular weight from 100,000 Da to 300,000 Da.

Enzymes: In addition to the enzymes present in the co-granule, the detergent composition may comprise one or more additional enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in the detergent composition of the invention, the aforementioned additional enzymes may be present at levels from about 0.00001% to about 2%, from about 0.0001% to about 1% or even from about 0.001% to about 0.5% enzyme protein by weight of the consumer product. The detailed information given below relates to enzymes suitable for incorporation into the co-granule or the detergent composition more generally other than via the co-granule.

In one aspect preferred enzymes would include a protease. Suitable proteases include metalloproteases and serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. No. 5,679,630, U.S. Pat. No. 4,760,025, U.S. Pat. No. 7,262,042 and WO09/021,867.

(b) trypsin-type or chymotrypsin-type proteases, such as trypsin (e.g., of porcine or bovine origin), including the *Fusarium* protease described in WO 89/06270 and the chymotrypsin proteases derived from *Cellumonas* described in WO 05/052161 and WO 05/052146.

(c) metalloproteases, including those derived from *Bacillus amyloliquefaciens* described in WO 07/044,993A2.

Preferred proteases include those derived from *Bacillus* gibsonii or *Bacillus Lentus*.

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao.

Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp. 707 (SEQ ID NO:7 in U.S. Pat. No. 6,093,562), especially those comprising one or more of the following mutations M202, M208, S255, R172, and/or M261. Preferably said amylase comprises one or more of M202L, M202V, M202S, M202T, M202I, M202Q, M202W, S255N and/or R172Q. Particularly preferred are those comprising the M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). In one aspect, suitable amylases include NATALASE®, STAINZYME® and STAINZYME PLUS® and mixtures thereof.

In one aspect, such enzymes may be selected from the group consisting of: lipases, including "first wash lipases" such as those described in U.S. Pat. No. 6,939,702 B1 and US PA 2009/0217464. In one aspect, the lipase is a first-wash lipase, preferably a variant of the wild-type lipase from *Thermomyces lanuginosus* comprising T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)). Preferred lipases would include those sold under the tradenames Lipex® and Lipolex®.

In one aspect, other preferred enzymes include microbial-derived endoglucanases exhibiting endo-beta-1,4-glucanase activity (E.C. 3.2.1.4), including a bacterial polypeptide endogenous to a member of the genus *Bacillus* which has a sequence of at least 90%, 94%, 97% and even 99% identity to the amino acid sequence SEQ ID NO:2 in U.S. Pat. No. 7,141,403B2) and mixtures thereof. Suitable endoglucanases are sold under the tradenames Celluclean® and Whitezyme® (Novozymes A/S, Bagsvaerd, Denmark).

Other preferred enzymes include pectate lyases sold under the tradenames Pectawash®, Pectaway®, Xpect® and mannanases sold under the tradenames Mannaway® (all from Novozymes A/S, Bagsvaerd, Denmark), and Purabrite® (Genencor International Inc., Palo Alto, Calif.).

Bleaching Agents: The detergent composition of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the detergent composition of the present invention may comprise from about 0.1% to about 50% or even from about 0.1% to about 25% bleaching agent by weight of the subject consumer product. Examples of suitable bleaching agents include:

(1) photobleaches for example sulfonated zinc phthalocyanine sulfonated aluminium phthalocyanines, xanthene dyes and mixtures thereof;

(2) preformed peracids: Suitable preformed peracids include, but are not limited to, compounds selected from the group consisting of percarboxylic acids and salts, percarbonic acids and salts, perimidic acids and salts, peroxymonosulfuric acids and salts, for example, Oxone®, and mixtures thereof. Suitable percarboxylic acids include hydrophobic and hydrophilic peracids having the formula R—(C═O)O—O-M wherein R is an alkyl group, optionally branched, having, when the peracid is hydrophobic, from 6 to 14 carbon atoms, or from 8 to 12 carbon atoms and, when the peracid is hydrophilic, less than 6 carbon atoms or even less than 4 carbon atoms; and M is a counterion, for example, sodium, potassium or hydrogen. The pre-formed peroxyacid or salt thereof is preferably a peroxycarboxylic acid or salt thereof, typically having a chemical structure corresponding to the following chemical formula:

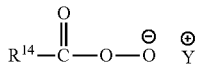

wherein: $R^{14}$ is selected from alkyl, aralkyl, cycloalkyl, aryl or heterocyclic groups; the $R^{14}$ group can be linear or branched, substituted or unsubstituted; and Y is any suitable counter-ion that achieves electric charge neutrality, preferably Y is selected from hydrogen, sodium or potassium. Preferably, $R^{14}$ is a linear or branched, substituted or unsubstituted $C_{6-14}$ alkyl. When the peracid is hydrophobic, preferably $R^{14}$ has from 6 to 14 carbon atoms, or from 8 to 12 carbon atoms and, when the peracid is hydrophilic, $R^{14}$ preferably has less than 6 carbon atoms or even less than 4 carbon atoms. Preferably, the peroxyacid or salt thereof is selected from peroxyhexanoic acid, peroxyheptanoic acid, peroxyoctanoic acid, peroxynonanoic acid, peroxydecanoic acid, any salt thereof, or any combination thereof. Particularly preferred peroxyacids are phthalimido-peroxy-alkanoic acids, in particular ε-phthahlimido peroxy hexanoic acid (PAP). Preferably, the peroxyacid or salt thereof has a melting point in the range of from 30° C. to 60° C.

The pre-formed peroxyacid or salt thereof can also be a peroxysulphonic acid or salt thereof, typically having a chemical structure corresponding to the following chemical formula:

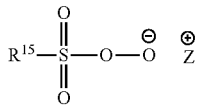

wherein: $R^{15}$ is selected from alkyl, aralkyl, cycloalkyl, aryl or heterocyclic groups; the $R^{15}$ group can be linear or branched, substituted or unsubstituted; and Z is any suitable counter-ion that achieves electric charge neutrality, preferably Z is selected from hydrogen, sodium or potassium. Preferably $R^{15}$ is a linear or branched, substituted or unsubstituted $C_{6-9}$ alkyl. Preferably such bleach components may be present in the compositions of the invention in an amount from 0.01 to 50%, most preferably from 0.1% to 20%;

(3) sources of hydrogen peroxide, for example, inorganic perhydrate salts, including alkali metal salts such as sodium salts of perborate (usually mono- or tetra-hydrate), percarbonate, persulphate, perphosphate, persilicate salts and mixtures thereof. In one aspect of the invention the inorganic perhydrate salts are selected from the group consisting of sodium salts of perborate, percarbonate and mixtures thereof. When employed, inorganic perhydrate salts are typically present in amounts of from 0.05 to 40 wt %, or 1 to 30 wt % of the overall fabric and home care product and are typically incorporated into such fabric and home care products as a crystalline solid that may be coated. Suitable coatings include, inorganic salts such as alkali metal silicate, carbonate or borate salts or mixtures thereof, or organic materials such as water-soluble or dispersible polymers, waxes, oils or fatty soaps; and (4) bleach activators having R—(C═O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Examples of suitable leaving groups are benzoic acid and derivatives thereof—especially benzene sulphonate. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS). Suitable bleach activators are also disclosed in WO 98/17767. While any suitable bleach activator may be employed, in one aspect of the invention the subject consumer product may comprise NOBS, TAED or mixtures thereof.

When present, the peracid and/or bleach activator is generally present in the consumer product in an amount of from about 0.1 to about 60 wt %, from about 0.5 to about 40 wt % or even from about 0.6 to about 10 wt % based on the fabric and home care product. One or more hydrophobic peracids or precursors thereof may be used in combination with one or more hydrophilic peracid or precursor thereof.

The amounts of hydrogen peroxide source and peracid or bleach activator may be selected such that the molar ratio of available oxygen (from the peroxide source) to peracid is from 1:1 to 35:1, or even 2:1 to 10:1.

(5) organic bleach catalysts—The detergent composition of the present invention may also include one or more bleach catalysts capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof, as described in USPA 2007/0173430 A1.

In one aspect, the bleach catalyst has a structure corresponding to general formula below:

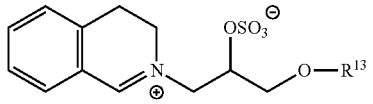

wherein $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl;

(6) Metal-based bleach catalysts—The bleach component may be provided by a catalytic metal complex. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243. Preferred catalysts are described in WO09/839,406, US6218351 and WO00/012667. Particularly preferred are transition metal catalyst or ligands therefore that are cross-bridged polydentate N-donor ligands.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. No. 5,597,936; U.S. Pat. No. 5,595,967. Such cobalt catalysts are readily prepared by known procedures, such as taught for example in U.S. Pat. No. 5,597,936, and U.S. Pat. No. 5,595,967.

Compositions herein may also suitably include a transition metal complex of ligands such as bispidones (U.S. Pat. No. 7,501,389) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in U.S. Pat. No. 6,225,464 and WO 00/32601.

Surfactants: The detergent composition according to the present invention may comprise a surfactant or surfactant system wherein the surfactant can be selected from nonionic surfactants, anionic surfactants, cationic surfactants, ampholytic surfactants, zwitterionic surfactants, semi-polar nonionic surfactants and mixtures thereof. When present, surfactant is typically present at a level of from about 0.1% to about 60%, from about 1% to about 50% or even from about 5% to about 40% by weight of the subject consumer product.

Suitable anionic detersive surfactants include sulphate and sulphonate detersive surfactants. Suitable sulphonate detersive surfactants include alkyl benzene sulphonate, in one aspect, $C_{10-13}$ alkyl benzene sulphonate. Suitable alkyl benzene sulphonate (LAS) may be obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. Suitable sulphate detersive surfactants include alkyl sulphate, in one aspect, $C_{8-18}$ alkyl sulphate, or predominantly $C_{12}$ alkyl sulphate. Another suitable sulphate detersive surfactant is alkyl alkoxylated sulphate, in one aspect, alkyl ethoxylated sulphate, in one aspect, a $C_{8-18}$ alkyl alkoxylated sulphate, in another aspect, a $C_{8-18}$ alkyl ethoxylated sulphate, typically the alkyl alkoxylated sulphate has an average degree of alkoxylation of from 0.5 to 20, or from 0.5 to 10, typically the alkyl alkoxylated sulphate is a $C_{8-18}$ alkyl ethoxylated sulphate having an average degree of ethoxylation of from 0.5 to 10, from 0.5 to 7, from 0.5 to 5 or even from 0.5 to 3. The alkyl sulphate, alkyl alkoxylated sulphate and alkyl benzene sulphonates may be linear or branched, substituted or unsubstituted.

The detersive surfactant may be a mid-chain branched detersive surfactant, in one aspect, a mid-chain branched anionic detersive surfactant, in one aspect, a mid-chain branched alkyl sulphate and/or a mid-chain branched alkyl benzene sulphonate, for example a mid-chain branched alkyl sulphate. In one aspect, the mid-chain branches are $C_{1-4}$ alkyl groups, typically methyl and/or ethyl groups.

Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein the alkoxylate units may be ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, typically having an average degree of alkoxylation of from 1 to 30; alkylpolysaccharides, in one aspect, alkylpolyglycosides; polyhydroxy fatty acid amides; ether capped poly (oxyalkylated) alcohol surfactants; and mixtures thereof. Suitable non-ionic detersive surfactants include alkyl polyglucoside and/or an alkyl alkoxylated alcohol. In one aspect, non-ionic detersive surfactants include alkyl alkoxylated alcohols, in one aspect $C_{8-18}$ alkyl alkoxylated alcohol, for example a $C_{8-18}$ alkyl ethoxylated alcohol, the alkyl alkoxylated alcohol may have an average degree of alkoxylation of from 1 to 50, from 1 to 30, from 1 to 20, or from 1 to 10. In one aspect, the alkyl alkoxylated alcohol may be a $C_{8-18}$ alkyl ethoxylated alcohol having an average degree of ethoxylation of from 1 to 10, from 1 to 7, more from 1 to 5 or from 3 to 7. The alkyl alkoxylated alcohol can be linear or branched, and substituted or unsubstituted.

Suitable cationic detersive surfactants include alkyl pyridinium compounds, alkyl quaternary ammonium compounds, alkyl quaternary phosphonium compounds, alkyl ternary sulphonium compounds, and mixtures thereof. Suitable cationic detersive surfactants are quaternary ammonium compounds having the general formula:

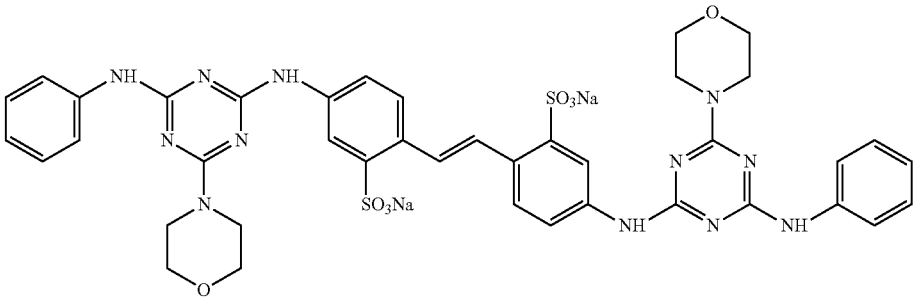

$(R)(R_1)(R_2)(R_3)N^+X^-$ wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-$C_{6-18}$ alkyl mono-hydroxyethyl di-methyl quaternary ammonium chlorides. Highly suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Chelating Agents: The detergent composition herein may contain a chelating agent. Suitable chelating agents include copper, iron and/or manganese chelating agents and mixtures thereof. When a chelating agent is used, the subject consumer product may comprise from about 0.005% to about 15% or even from about 3.0% to about 10% chelating agent by weight of the subject consumer product. Suitable chelants include DTPA (Diethylene triamine pentaacetic acid), HEDP (Hydroxyethane diphosphonic acid), DTPMP (Diethylene triamine penta(methylene phosphonic acid)), 1,2-Dihydroxybenzene-3,5-disulfonic acid disodium salt hydrate, ethylenediamine, diethylene triamine, ethylenediaminedisuccinic acid (EDDS), N-hydroxyethylethylenediaminetri-acetic acid (HEDTA), triethylenetetraaminehexaacetic acid (TTHA), N-hydroxyethyliminodiacetic acid (HEIDA), dihydroxyethylglycine (DHEG), ethylenediaminetetrapropionic acid (EDTP) and derivatives thereof.

Dye Transfer Inhibiting Agents: The detergent composition of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject consumer product, the dye transfer inhibiting agents may be present at levels from about 0.0001% to about 10%, from about 0.01% to about 5% or even from about 0.1% to about 3% by weight of the consumer product. Brighteners: The detergent composition of the present invention can also contain additional components that may tint articles being cleaned, such as fluorescent brighteners.

The composition may comprise C.I. fluorescent brightener 260 in alpha-crystalline form having the following structure:

In one aspect, the brightener is a cold water soluble brightener, such as the C.I. fluorescent brightener 260 in alpha-crystalline form.

In one aspect the brightener is predominantly in alpha-crystalline form, which means that typically at least 50 wt %, at least 75 wt %, at least 90 wt %, at least 99 wt %, or even substantially all, of the C.I. fluorescent brightener 260 is in alpha-crystalline form. The brightener is typically in micronized particulate form, having a weight average primary particle size of from 3 to 30 micrometers, from 3 micrometers to 20 micrometers, or from 3 to 10 micrometers.

The composition may comprise C.I. fluorescent brightener 260 in beta-crystalline form, and the weight ratio of: (i) C.I. fluorescent brightener 260 in alpha-crystalline form, to (ii) C.I. fluorescent brightener 260 in beta-crystalline form may be at least 0.1, or at least 0.6. BE680847 relates to a process for making C.I fluorescent brightener 260 in alpha-crystalline form.

Suitable fluorescent brightener levels include lower levels of from about 0.01, from about 0.05, from about 0.1 or even from about 0.2 wt % to upper levels of 0.5 or even 0.75 wt %.

Silicate salts—The detergent composition of the present invention can also contain silicate salts, such as sodium or potassium silicate. The composition may comprise from 0 wt % to less than 10 wt % silicate salt, to 9 wt %, or to 8 wt %, or to 7 wt %, or to 6 wt %, or to 5 wt %, or to 4 wt %, or to 3 wt %, or even to 2 wt %, and preferably from above 0 wt %, or from 0.5 wt %, or even from 1 wt % silicate salt. A suitable silicate salt is sodium silicate.

Dispersants—The detergent composition of the present invention can also contain dispersants. Suitable water-soluble organic materials include the homo- or co-polymeric acids or their salts, in which the polycarboxylic acid comprises at least two carboxyl radicals separated from each other by not more than two carbon atoms.

Enzyme Stabilizers—Enzymes for use in the detergent composition can be stabilized by various techniques. The enzymes employed herein can be stabilized by the presence of water-soluble sources of calcium and/or magnesium ions in the finished fabric and home care products that provide such ions to the enzymes. In the case of detergent compositions comprising protease, a reversible protease inhibitor, such as a boron compound, or compounds such as calcium formate, sodium formate and 1,2-propane diol can be added to further improve stability. Solvents—Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

Processes of Making the Detergent Composition

The detergent composition of the present invention are preferably in granular form, optionally the granules being incorporated into a unit dose detergent composition as described above.

Method of Use

The present invention includes a method of treating and/or cleaning a surface, preferably a fabric surface comprising the steps of (i) contacting said surface with a composition according to any of claims 1 to 11 in an aqueous wash liquor, (ii) rinsing and/or drying the surface, preferably the temperature of the aqueous liquor is from 5-25° C. and preferably the aqueous liquor comprises from 0.1 g/l to 3 g/l of surfactant.

Co-Granule Example 1

Enzyme co-granules are prepared according to the process described in example 1 of US2008/0206830A1, however the granules each comprising the enzymes as outlined and in the weight ratios in the formulation examples below. Thus the enzyme granules comprise a core of enzyme, sucrose/starch and magnesium sulphate heptahydrate (relative weight ratio approximately 6:68:27), and a coating comprising polyvinyl alcohol, titanium dioxide and nonionic surfactant (relative weight ratio approximately 40:50:10). The enzyme concentration in the granules is approximately 40 g/kg.

Formulation Examples 1-7

Granular Laundry Detergent Compositions Designed for Hand Washing or Top-Loading Washing Machines.

| | 1 (wt %) | 2 (wt %) | 3 (wt %) | 4 (wt %) | 5 (wt %) | 6 (wt %) | 7 (wt %) |
|---|---|---|---|---|---|---|---|
| Linear alkylbenzenesulfonate | 18 | 20 | 22 | 20 | 15 | 20 | 20 |
| $C_{12-14}$ Dimethylhydroxyethyl ammonium chloride | 0.5 | 0.7 | 0.2 | 1 | 0.6 | 0.0 | 0 |
| AE3S | 1.0 | 0.9 | 1 | 0.9 | 0.0 | 0.5 | 0.9 |
| AE7 | 2.0 | 0.0 | 0.0 | 0.0 | 1 | 0.0 | 3 |
| Sodium tripolyphosphate | 5 | 5 | 0.0 | 4 | 9 | 2 | 0.0 |
| Zeolite A | 0 | 0.0 | 1 | 0.0 | 1 | 4 | 1 |
| 1.6R Silicate ($SiO_2$:$Na_2O$ at ratio 1.6:1) | 6 | 7 | 5 | 2 | 3 | 3 | 5 |
| Sodium carbonate | 26 | 25 | 20 | 25 | 17 | 18 | 19 |
| Polyacrylate MW 4500 | 1 | 1 | 0.6 | 1 | 1 | 1.5 | 1 |
| Random graft copolymer[1] | 0.1 | 0.1 | 0.2 | 0.0 | 0.0 | 0.0 | 0.0 |
| Carboxymethyl cellulose | 0.7 | 1 | 0.3 | 1 | 1 | 1 | 1 |
| Cellulase (15.6 mg active/g)* | 0.2 | 0.1 | 0.2 | 0.1 | 0.2 | 0.1 | 0.1 |
| Protease (32.89 mg active/g)* | 0.2 | 0.1 | 0.1 | 0.1 | 0.1 | | 0.1 |
| Amylase (8.65 mg active/g)* | 0.05 | 0.1 | 0.0 | 0.1 | 0.0 | 0.1 | 0.1 |
| First wash lipase (18 mg active/g)* | 0.03 | 0.03 | 0.07 | 0.3 | 0.1 | 0.07 | 0.4 |
| Fluorescent Brightener 1 | 0.05 | 0.06 | 0.0 | 0.06 | 0.18 | 0.06 | 0.06 |
| Fluorescent Brightener 2 | 0.1 | 0.1 | 0.06 | 0.1 | 0.0 | 0.1 | 0.1 |
| DTPA | 0.7 | 0.6 | 0.8 | 0.6 | 0.25 | 0.6 | 0.6 |
| $MgSO_4$ | 1.2 | 1 | 1 | 1 | 0.5 | 1 | 1 |
| Sodium Percarbonate | 4.6 | 0.0 | 5.2 | 0.1 | 0.0 | 0.0 | 0.0 |
| Sodium Perborate Monohydrate | 0 | 4.4 | 0.0 | 3.85 | 2.09 | 0.78 | 3.63 |
| NOBS | 1.5 | 1.9 | 0.0 | 1.66 | 0.0 | 0.33 | 0.75 |
| TAED | 0.6 | 0.58 | 1.2 | 0.51 | 0.0 | 0.015 | 0.28 |
| Sulphonated zinc phthalocyanine | 0.002 | 0.0030 | 0.0 | 0.0012 | 0.0030 | 0.0021 | 0.0 |
| CMC | 0.1 | 0.1 | 0.0 | 0.0 | 0.0 | 0.06 | 0.0 |
| Direct Violet 9/99/66 | 0.0001 | 0.0 | 0.0 | 0.0003 | 0.0005 | 0.0003 | 0.0 |
| Acid Blue 29 | 0.0001 | 0.0 | 0.0 | 0.0 | 0.0 | 0.0 | 0.0003 |

-continued

| | 1 (wt %) | 2 (wt %) | 3 (wt %) | 4 (wt %) | 5 (wt %) | 6 (wt %) | 7 (wt %) |
|---|---|---|---|---|---|---|---|
| Pigment Violet 23 | 0.0001 | 0.0001 | 0.0001 | 0.0001 | 0.0001 | 0.0001 | 0.0001 |
| Solvent violet 13 | 0.0001 | 0.0001 | 0.0001 | 0.0001 | 0.0001 | 0.0001 | 0.0001 |
| Anhydrous sodium sulfate | 25.0 | 26.0 | 30.0 | 36.0 | 40.0 | 45.0 | 57.0 |
| Moisture and misc | | | | Balance | | | |

*enzymes added via the co-granule from co-granule example 1.

Examples 3-13

Granular Laundry Detergent Compositions Designed for Front-Loading Automatic Washing Machines.

| | 8 (wt %) | 9 (wt %) | 10 (wt %) | 11 (wt %) | 12 (wt %) | 13 (wt %) |
|---|---|---|---|---|---|---|
| Linear alkylbenzenesulfonate | 8 | 7.1 | 7 | 6.5 | 7.5 | 7.5 |
| AE3S | 0 | 4.8 | 0 | 5.2 | 4 | 4 |
| C12-14 Alkylsulfate | 1 | 0 | 1 | 0 | 0 | 0 |
| AE7 | 2.2 | 0 | 3.2 | 0 | 0 | 0 |
| $C_{10-12}$ Dimethyl hydroxyethylammonium chloride | 0.75 | 0.94 | 0.98 | 0.98 | 0 | 0 |
| Crystalline layered silicate (δ-$Na_2Si_2O_5$) | 4.1 | 0 | 4.8 | 0 | 0 | 0 |
| Zeolite A | 5 | 0 | 5 | 0 | 2 | 2 |
| Citric Acid | 3 | 5 | 3 | 4 | 2.5 | 3 |
| Sodium Carbonate | 15 | 20 | 14 | 20 | 23 | 20 |
| Silicate 2R ($SiO_2$:$Na_2O$ at ratio 2:1) | 0.08 | 0 | 0.11 | 0 | 0 | 0 |
| Soil release agent | 0.75 | 0.72 | 0.71 | 0.72 | 0 | 0 |
| Acrylic Acid/Maleic Acid Copolymer | 1.1 | 3.7 | 1.0 | 3.7 | 2.6 | 3.8 |
| Carboxymethylcellulose | 0.15 | 1.4 | 0.2 | 1.4 | 1 | 0.5 |
| Protease (84 mg active/g)* | 0.2 | 0.2 | 0.3 | 0.15 | 0.12 | 0.13 |
| Amylase (20 mg active/g)* | 0.2 | 0.15 | 0.2 | 0.3 | 0.15 | 0.15 |
| First wash Lipase (18.00 mg active/g)* | 0.05 | 0.15 | 0.1 | 0 | 0 | 0 |
| Amylase (8.65 mg active/g)* | 0.1 | 0.2 | 0 | 0 | 0.15 | 0.15 |
| Cellulase (15.6 mg active/g)* | 0 | 0 | 0 | 0 | 0.1 | 0.1 |
| TAED | 3.6 | 4.0 | 3.6 | 4.0 | 2.2 | 1.4 |
| Percarbonate | 13 | 13.2 | 13 | 13.2 | 16 | 12 |
| EDDS | 0.2 | 0.2 | 0.2 | 0.2 | 0.2 | 0.2 |
| HEDP | 0.2 | 0.2 | 0.2 | 0.2 | 0.2 | 0.2 |
| $MgSO_4$ | 0.42 | 0.42 | 0.42 | 0.42 | 0.4 | 0.4 |
| Perfume | 0.5 | 0.6 | 0.5 | 0.6 | 0.6 | 0.6 |
| Suds suppressor agglomerate | 0.05 | 0.1 | 0.05 | 0.1 | 0.06 | 0.05 |
| Soap | 0.45 | 0.45 | 0.45 | 0.45 | 0 | 0 |
| Sulphonated zinc phthalocyanine (active) | 0.0007 | 0.0012 | 0.0007 | 0 | 0 | 0 |
| CMC | 0.01 | 0.01 | 0 | 0.01 | 0 | 0 |
| Direct Violet 9/99/66 and/or Solvent Violet 13 (active) | 0 | 0 | 0.0001 | 0.0001 | 0 | 0 |
| Anhydrous sodium sulfate | 27 | 30 | 30 | 32 | 26 | 35 |
| Water & Miscellaneous | | | | Balance | | |

Remark:
all enzyme levels expressed as % enzyme raw material
*enzymes added via the co-granule from co-granule example 1.

Any of the above compositions is used to launder fabrics at a concentration of 7000 to 10000 ppm in water, 20-90° C., and a 5:1 water:cloth ratio. The typical pH is about 10. The fabrics are then dried. In one aspect, the fabrics are actively dried using a dryer. In one aspect, the fabrics are actively dried using an iron. In another aspect, the fabrics are merely allowed to dry on a line wherein they are exposed to air and optionally sunlight.

Raw Materials and Notes for Composition Examples 1-20

Alkylbenzenesulfonate, linear average aliphatic carbon chain length $C_{11}$-$C_{12}$.

AE3S is $C_{12-15}$ alkyl ethoxy (3) sulfate.

AE7 is $C_{12-15}$ alcohol ethoxylate, with an average degree of ethoxylation of 7.

AE9 is $C_{12-13}$ alcohol ethoxylate, with an average degree of ethoxylation of 9.

HSAS is a mid-branched primary alkyl sulfate with carbon chain length of about 16-17 Chelants may be diethylenetetraamine pentaacetic acid (DTPA), sodium hydroxyethane di phosphonate (HEDP) or sodium ethylene diamine-N,N-disuccinic acid (S,S)isomer (EDDS) Savinase®, Natalase®, Stainzyme®, Lipex®, Celluclean™, Mannaway® and Whitezyme® are all products of Novozymes, Bagsvaerd, Denmark.

Fluorescent Brightener 1 is Tinopal® AMS, Fluorescent Brightener 2 is Tinopal® CBS-X, Sulphonated zinc phthalocyanine NOBS is sodium nonanoyloxybenzenesulfonate.

TAED is tetraacetylethylenediamine.

Soil release agent is Repel-o-tex® PF, supplied by Rhodia, Paris, France

Acrylic Acid/Maleic Acid Copolymer is m wt 70,000 and acrylate:maleate ratio 70:30.

HSAS is mid-branched alkyl sulfate as disclosed in U.S. Pat. No. 6,020,303 and U.S. Pat. No. 6,060,443

Liquitint® Violet CT is supplied by Milliken, Spartanburg, S.C., USA

Random graft copolymer is a polyvinyl acetate grafted polyethylene oxide copolymer having a polyethylene oxide backbone and multiple polyvinyl acetate side chains (m wt about 6000, weight ratio of the polyethylene oxide to polyvinyl acetateabout 40 to 60).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A detergent composition comprising:

(a) a multi-enzyme co-granule comprising from 10 to 98 wt % moisture sink component;

(b) less than 3 wt % zeolite (anhydrous basis);

(c) less than 3 wt % phosphate salt (anhydrous basis);

(d) from 5 wt % to 35 wt % of sodium percarbonate, (e) a fabric shading dye selected from solvent, dyes, disperse dyes, acid dyes, direct dyes, pigment or mixtures thereof, (f) a protease enzyme, (g) a lipase enzyme, (h) and the composition additionally comprises from 40 to 75 wt % detergent moisture sink component, wherein the multi-enzyme co-granule has a core-shell structure, wherein the core comprises a central part free of the enzymes and a surrounding layer comprising the enzymes, wherein the shell comprises a plurality of layers, wherein a central part of the core and at least one of the shell layers comprises the moisture sink component, the most outer layer is titanium oxide and polyvinyl alcohol and is from 1% to 3% by weight of the total particle, wherein the central part of the core is from 5% to 40% by weight of the total particle and the layer comprising the moisture sink component is from 3% to 20% by weight of the particle, wherein the detergent moisture sink component is sodium sulphate, wherein the co-granule has a weight geometric mean particle size of from about 600 microns to about 1000 microns.

2. A detergent composition according to claim 1 wherein the multi-enzyme cogranule comprises (a) one or more enzymes selected from the group consisting of first-wash lipases, cleaning cellulases, xyloglucanases, perhydrolases, peroxidases, lipoxygenases, laccases and mixtures thereof; and (b) one or more enzymes selected from the group consisting of hemicellulases, care cellulases, cellobiose dehydrogenases, xylanases, phospholipases, esterases, cutinases, pectinases, mannanases, pectate lyases, keratinases, reductases, oxidases, phenoloxidases, ligninases, pullulanases, tannases, pentosanases, lichenases glucanases, arabinosidases, hyaluronidase, chondroitinase, amylases, and mixtures thereof.

3. A detergent composition according to claim 1 wherein the multi-enzyme co-granule comprises lipase and protease in a weight ratio of from 2:5 to 1:1.

4. A detergent composition according to claim 1 wherein the moisture sink component and the total active enzyme are present in the multi-enzyme co-granule in a weight ratio from 4:1 to 40:1.

5. A detergent composition according to claim 1 further comprising a dye transfer inhibiting agent.

6. A detergent composition according to claim 1 further comprising one or more of the following adjuncts:

(a) an encapsulate comprising a perfume;

(b) a surfactant system comprising an anionic surfactant and a nonionic surfactant in the weight ratio from 20:1 to 1:10;

(c) a silicate salt selected from the group consisting of sodium silicate, potassium silicate and mixtures thereof;

(d) a carboxylate polymer selected from the group consisting of maleate/acrylate random copolymer or polyacrylate homopolymer and mixtures thereof;

(e) a soil release polymer selected from the group consisting of terephthalate co-polymers and mixtures thereof;

(f) a cellulosic polymer selected from the group consisting of alkyl cellulose, alkyl alkoxyalkyl cellulose, carboxyalkyl cellulose, alkyl carboxyalkyl cellulose and mixtures thereof;

(g) a chelant selected from the group consisting of DTPA (Diethylene triamine pentaacetic acid), HEDP (Hydroxyethane diphosphonic acid), DTPMP (Diethylene triamine penta(methylene phosphonic acid)), ethylenediaminedisuccinic acid (EDDS), 1,2-Dihydroxybenzene-3,5-disulfonic acid disodium salt hydrate, derivatives of said chelants; and (h) mixtures thereof.

7. A composition according to claim 1 further comprising one or more bleach particles selected from the group consisting of:

(a) a bleach catalyst comprising a material selected from the group consisting of iminium cations, iminium polyions; iminium zwitterions; modified amines; modified amine oxides; N-sulphonyl imines; N-phosphonyl imines; N-acyl imines; thiadiazole dioxides; perfluoroimines; cyclic sugar ketones, transition metal catalysts or ligands for the formation thereof, and mixtures thereof;

(b) a bleach activator comprising a material selected from the group consisting of dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED), nonanoyloxybenzene sulphonate (NOBS) and mixtures thereof;

(c) a metal catalyst;

(d) a photo-bleach selected from the group consisting of zinc aluminium phthalocyanine compounds, Food red, erythrosine, Rose Bengal, and mixtures thereof; and (e) mixtures thereof.

* * * * *